United States Patent [19]

Goudy, Jr.

[11] 4,369,835

[45] Jan. 25, 1983

[54] THERMAL ENERGY TRANSFER APPARATUS AND METHOD

[75] Inventor: Paul R. Goudy, Jr., 2415 Stratford Ct., Shorewood, Wis. 53211

[73] Assignees: Bruce J. Landis, Sunrise, Fla.; Kenneth J. Landis, University Heights, Ohio; Paul R. Goudy, Jr., Shorewood, Wis. ; a part interest

[21] Appl. No.: 148,002

[22] Filed: May 8, 1980

[51] Int. Cl.[3] ..... F28D 7/10

[52] U.S. Cl. ..... 165/154; 165/154; 165/179; 219/301; 219/306; 219/530; 219/540

[58] Field of Search ..... 165/164, 172, 179, 81, 165/154; 122/367 R

[56] References Cited

U.S. PATENT DOCUMENTS

| | | | |
|---|---|---|---|
| 1,734,274 | 11/1929 | Schubart | 122/367 R X |
| 2,451,629 | 10/1948 | McCollum | 165/179 X |
| 3,195,626 | 7/1965 | Druseikis et al. | 165/172 X |
| 3,409,075 | 11/1968 | Long | 165/154 |
| 3,450,199 | 6/1969 | Warrell | 165/81 |
| 3,735,810 | 5/1973 | Ostbo | 165/179 X |

*Primary Examiner*—Samuel Scott
*Assistant Examiner*—Theophil W. Streule, Jr.
*Attorney, Agent, or Firm*—Maky, Renner, Otto & Boisselle

[57] ABSTRACT

A thermal energy transfer apparatus and method to efficiently transfer thermal energy between two or more media, such as plural fluids, a fluid and a solid, two solids, etc. A thermally conductive mesh-like member provides relatively large surface areas for energy transfer therethrough. In one embodiment the mesh-like member disperses a fluid flowing therethrough while simultaneously effecting efficient and substantial thermal energy transfer therewith. A pair of thermally conductive generally solid discs direct the fluid into and receive fluid from the mesh-like member while also distributing thermal energy in the mesh-like member and/or transferring thermal energy with respect to the latter, for example, to a source or dissipator of thermal energy.

35 Claims, 9 Drawing Figures

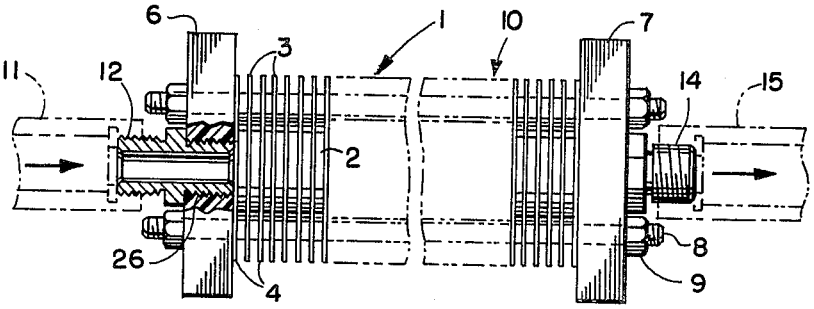
FIG. 1
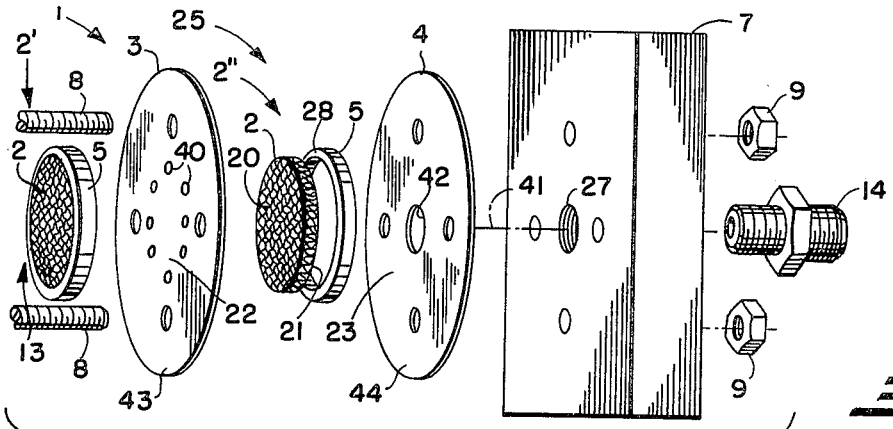
FIG. 2
FIG. 3
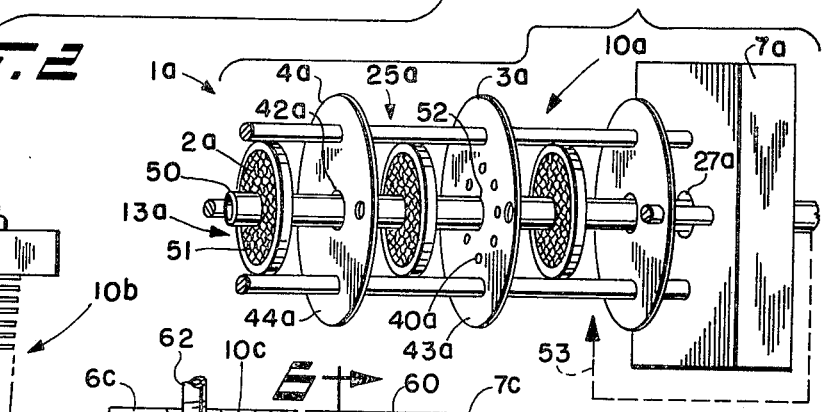
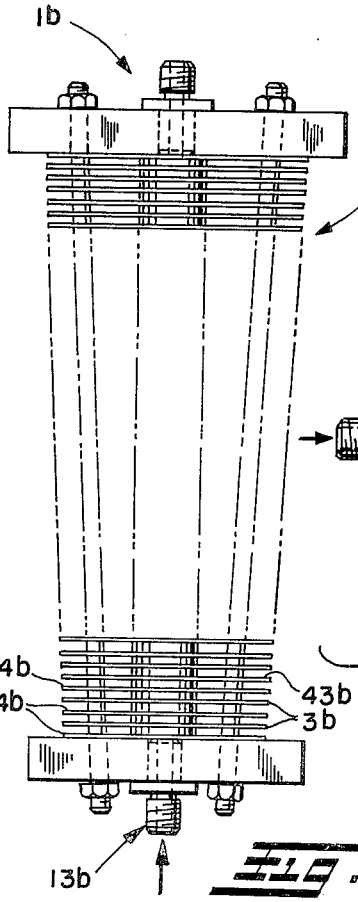
FIG. 4
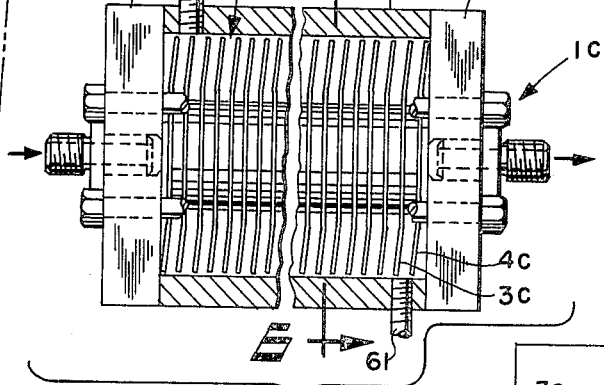
FIG. 5
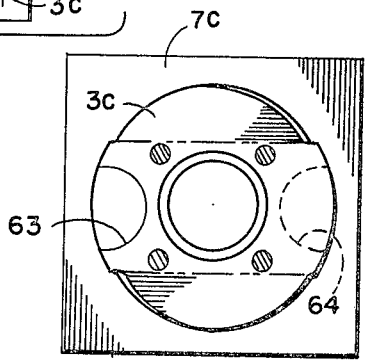
FIG. 6

THERMAL ENERGY TRANSFER APPARATUS AND METHOD

TECHNICAL FIELD

The present invention relates to thermal energy transfer apparatus and to a method for efficiently transferring thermal energy between media.

BACKGROUND OF PRIOR ART

One example of a prior heat exchanger used, for example, in a room heating convector apparatus includes, for example, a pipe through which hot water flows, plural fins on the pipe, and a blower for blowing air across the pipe and fins so that the air is heated during such passage. Another example of a conventional heat exchanger is the radiator apparatus of a motor vehicle, and still other examples are domestic and commercial furnaces, boilers, hot water heaters, etc.

The various prior heat exchanger are inefficient in a number of respects. Typically a liquid flowing through a pipeline of the heat exchanger generally experiences laminar flow in which there is minimal boundary layer movement relative to the central stream area, and the slow motion at the boundary layer area tends to create a thermal insulating effect. Thus, heat transfer to the material of the pipeline is impeded by the boundary layer insulation and the laminar flow with relatively higher velocity center-stream conditions further reduce the transfer of heat energy to the heat transfer medium of the pipeline. Moreover, to increase the outside surface area of the heat exchanger, which is typically designed to have air or other gas blown thereacross, fins are welded or otherwise secured to the outside surface of the pipeline. The connections of the fins to the outside surfaces of the pipeline frequently impede the conduction of heat between the pipeline material and the major portion of the fin material. Additionally, at such junctions, there frequently is a build-up of heat, which further impedes the conduction of heat thereat.

Other disadvantages with prior art heat exchangers are their large size, equipment cost, and operation cost. A disadvantage of present automotive radiators is the large size and weight thereof. These all contribute negatively to principles of conservation of energy, natural resources, capital, space, etc.

There are, of course, three types of heat transfer, namely conduction, convection and radiation. Conduction is the most efficient and most heat exchangers employ both conduction and convection. However, conduction with respect to fluid in the heat exchanger is impeded and made inefficient due to the boundary layer insulation effect mentioned above.

SUMMARY OF THE INVENTION

In the present invention, though, conduction efficiency is improved, for example, by providing large surface areas at which conduction may occur and by breaking up boundary layers to avoid insulating effects.

In accordance with the present invention there are disclosed thermal energy transfer apparatus and a method of thermal energy transfer that are improved over prior apparatus and methods. The invention provides for improved thermal energy transfer efficiency ordinarily accomplished in a reduced volume and at reduced equipment and operational cost than was heretofore possible.

In accordance with one aspect of the present invention a thermal energy transfer apparatus for transferring thermal energy between plural media includes thermally conductive mesh-like means having a relatively large cumulative surface area for transferring thermal energy therethrough, a pair of thermally conductive discs engaged with the mesh-like means for transferring thermal energy with respect to the latter, and a holder for holding the mesh-like means and the discs in relatively fixed operative spacial relation. In accordance with a more specific aspect of the invention, the mesh-like means disperses fluid flowing therethrough while simultaneously effecting efficient and substantial thermal energy transfer therewith and the discs direct the fluid into and receive fluid from the mesh-like means.

According to another aspect, a thermal energy transfer apparatus includes fluid flow means for conducting the flow of fluid therethrough including dispersing means for dispersing the fluid flowing through the fluid flow means, and thermal energy transfer means for transferring thermal energy with respect to the dispersing means for transfer between the latter and such fluid flowing therethrough.

According to another aspect, a thermal energy transfer apparatus includes fluid dispersing means for dispersing fluid flowing therethrough, fluid delivery means for delivering fluid to the fluid dispersing means, fluid receiving means for receiving fluid having flowed through the fluid dispersing means, and thermal energy transfer means for transferring thermal energy with respect to the fluid dispersing means for transfer between the latter and such fluid flowing therethrough.

According to another aspect of the invention, a method of transferring thermal energy with respect to a fluid flowing in a heat exchanger includes dispersing the fluid as it flows through the heat exchanger using a dispersing medium and transferring thermal energy with respect to the dispersing medium for transfer between the latter and the fluid being dispersed thereby.

The present invention will be described herein with respect to a heat exchanger in which it is intended to deliver heat to or to remove heat from one water medium. However, it will be appreciated that such medium actually may be plural media and such media may be another liquid, gas or solid. It will be appreciated, too, that the use of the phrase "heat exchanger" herein broadly means a thermal energy transfer apparatus which may deliver cold or remove cold from the described one or disclosed plural media.

With the foregoing introduction and following detailed description in mind, it is a primary object of the present invention to provide a thermal energy transfer apparatus and method that are improved in the disclosed respects.

Another object is to improve the efficiency of thermal energy transfer in a heat exchanger or the like, especially by providing a relatively large amount of conductive energy transfer.

An additional object is to transfer thermal energy directly between two environments, e.g. between the inside and outside of a heat exchanger.

A further object is to transfer thermal energy between plural fluids.

Still another object is to reduce or to minimize boundary layer thermal energy insulating effects in a heat exchanger.

Still an additional object is to reduce the cost, size, weight and cost of operation of heat exchangers, such as water heaters, radiators, boilers, furnaces, air conditioning equipment, heat pumps and other equipment.

Still a further object is to increase the heat exchange surface areas at which thermal energy is transferred relative to a fluid.

Even another object is to improve the uniformity of temperature and thermal energy transfer in a fluid, especially by causing a turbulence-like mixing while maintaining over-all laminar flow characteristics of fluid flowing through a heat exchanger.

Even an additional object is to minimize thermal energy build-up and other so-called bottlenecks at the transfer media or elsewhere in a heat exchanger.

These and other objects and advantages of the present invention will become more apparent as the following description proceeds.

To the accomplishment of the foregoing and related ends, the invention, then, comprises the features hereinafter fully described in the specification and particularly pointed out in the claims, the following description and the annexed drawings setting forth in detail certain illustrative embodiments of the invention, these being indicative, however, of but several of the various ways in which the principles of the invention may be employed.

BRIEF DESCRIPTION OF DRAWINGS

In the annexed drawings:

FIG. 1 is a side view, partly broken away in section, of a heat exchanger in accordance with the present invention;

FIG. 2 is a partial exploded three-quarters view of the heat exchanger of FIG. 1;

FIG. 3 is a partial three-quarters exploded view of an alternate embodiment of heat exchanger in accordance with the invention;

FIG. 4 is a front elevation view of another alternate embodiment of heat exchanger in accordance with the invention;

FIGS. 5 and 6 are, respectively, side elevation and section views, the latter being taken along the lines 6—6 of FIG. 5, of an additional alternate embodiment in accordance with the invention;

DETAILED DESCRIPTION

Figure 7:
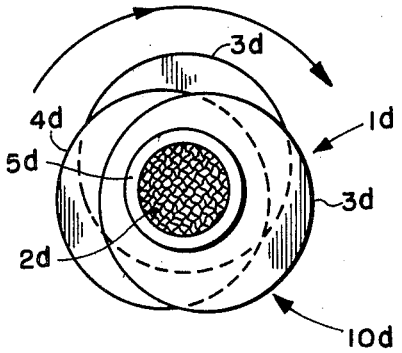
FIG. 7 is a schematic illustration of a plan view of a further alternate embodiment of heat exchanger in accordance with the invention.

Referring now in detail to the drawings, and initially to FIGS. 1 and 2, a thermal energy transfer apparatus in accordance with the present invention and hereinafter referred to generally as a heat exchanger for convenience of description, as was mentioned above, is generally indicated at 1. The fundamental components of the heat exchanger 1 include a principal heat transferring medium 2 and thermal energy conducting or heat exchange plates or discs 3, 4. The medium 2 is held in a support ring 5, and the assemblage of media 2, discs 3, 4, and support rings 5 is held together or secured as an integral structure between end plates or blocks 6, 7 by threaded fastening rods 8 and fastener nuts 9.

In the preferred embodiment and best mode of the invention, the heat exchanger 1 is intended to facilitate raising the temperature of one fluid, say water, which flows through the heat exchanger 1, by applying heat to the heating zone 10 externally of the heat exchanger 1. Accordingly, water supplied via an inlet pipe or hose 11 passes through an inlet fitting 12 in the inlet block 6, through an internal flow path 13, through an outlet fitting 14 in the outlet block 7 and to a downstream location via an outlet pipe or hose 15. The fluid flowing through the internal flow path 13 may be another gas or liquid other than water. Heat may be applied to the heating zone 10 by the hot products of combustion from, for example, a gas or oil flame, not shown, by hot water or other fluid, by electric heating means, etc. It is the object of the heat exchanger 1 to transfer heat from the heating zone 10 to the internal fluid flowing through the internal flow path 13 while preferably maintaining fluidic and/or other isolation between the internal flow path 13 and the heating zone 10, for example, to avoid water leakage.

In the preferred embodiment as well as in the additional embodiments disclosed hereinafter, the medium 2 is of a material that is a good conductor of thermal energy, for example, copper, aluminum, or like material. Moreover, such material should not be affected by fluid contacting the same, or at least such affectation should be relatively minimized. The general configuration of the heat transfer medium 2 preferably is disc-like with faces 20, 21 that may be placed in direct or intimate engagement with internal heat exchange surfaces 22, 23 of the heat exchange discs 3, 4. The faces 20, 21, i.e. the major surface area portions of the discs as opposed to the relatively thin edges thereof, should be relatively large to provide a relatively large area of contact with the surfaces 22, 23 between which the medium 2 is effectively sandwiched. Internally the medium 2 should contain large surface areas for contact with the water flowing therethrough to optimize transfer of thermal energy therebetween. Furthermore, the medium 2 preferably has a substantial fluid dispersing characteristic capable of dispersing fluid flowing internally thereof for maximizing thermal energy transfer therewith, for avoiding stagnant flow areas therein, for minimizing channeling of fluid flowing therethrough, and for mixing fluid therein for uniformity of temperature and, accordingly, optimized thermal energy transfer; the thickness of the medium 2 in the net axial flow direction of the internal flow path 13 also should be selected to contribute positively to achievement of the foregoing. The medium 2 preferably is of circular plan, as shown, to avoid areas for fluid stagnation, for example in corners of a rectangular or similar shape medium.

According to the preferred embodiment and best mode, the heat transferring medium 2 is of mesh or mesh-like material, such as that of a metal filter, screen or the like. Such material provides the aforesaid characteristics, including those of fluid dispersion and mixing, large surface areas for heat transfer engagement with the fluid flowing therethrough and large faces 20, 21 for heat transfer engagement with the surfaces 22, 23 of the discs 3, 4. The mesh-like material of the heat transferring medium 2 may be compressed from a relaxed state between the discs 3, 4 and by the ring 5 such that faces 20, 21 become nearly integral, and, in any event, maintain good heat transfer conduction, with the surfaces 22, 23. The mesh medium 2 also may be compressed, as required, to fit snugly in the support ring 5 avoiding fluid flow at the effective interface between the medium and support ring and to provide, if desired, a fluid flow impedance and to optimize surface area exposure particularly to fluid flowing through the medium. Furthermore, to minimize the pressure drop of or flow impedance to fluid flowing through the heat transferring medium 2 and to avoid flow stagnation, it is preferred that the net open cross-sectional area integrated across a section of the medium 2 taken generally normal to the net internal flow path 13 therethrough is substantially constant in each of the media 2 employed in the heat exchanger 1 and, in fact, approximately equals the open cross-sectional area of the fluid inlet fitting 12 and fluid outlet fitting 14.

Each heat transferring medium 2 in combination with the respective adjacent relatively upstream and downstream heat exchange discs 3, 4 jointly form a sandwich like heat exchange unit 25 of which preferably there is a plurality thereof used in the heat exchanger 1. For example, the heat exchanger 1 may include thirty or more such heat exchange units 25. Preferably there is a heat exchange disc 4 adjacent the respective threaded inlet and outlet passages 26, 27 in the respective blocks 6, 7, and the remaining heat exchange discs 3, 4 employed in the heat exchanger 1 are shared in respectively adjacent heat exchange units 25. For example, the heat exchange disc 3 illustrated in FIG. 2 is employed as a part of the heat exchange unit 25 to the right thereof as well as of the heat exchange unit to the left thereof. The support rings 5 may be of rigid metal material, such as aluminum of cylindrical configuration to circumscribe the edge of respective heat transferring media 2 and with flat annular faces 28 that provide fluid-tight sealing engagement with respective surfaces of respective heat exchange plates 3, 4. The support ring 5 may be of a material that is a good thermal energy conductor further to enhance the conducting of thermal energy from the heating zone 10 into the area of the internal flow path 13. Further to maintain the fluid-tight integrity of the internal flow path 13, if desired, additional conventional anti-leakage means, such as caulking, elastomeric coatings, etc. may be employed at the junctures of discs 3, 4 with support rings 5; alternatively, the support rings themselves may be formed of anti-leakage material, such as relatively resilient material rather than rigid metal, plastic or the like. The support ring 5 may be eliminated if the heat transferring medium 2 has adequate strength for self-support under compression between respective discs 3, 4 and if preferably the outer cylindrical surface of the medium 2 is adequately fluid impermeable to avoid leakage thereat. The rods 8 and fasteners 9 are tightened relatively securely effectively clamping the heat exchange units 25 between the respective blocks 6, 7 to maintain the fluid-tight integrity of the internal flow path 13. A plurality of mounting rod holes 29 in the discs 3, 4 allow passage of the respective rods 8 therethrough.

The heat exchange discs 3, 4 provide fluid flow control functions. For example, the disc 3 has a plurality of fluid guiding openings 40 spaced in a circle radially about the approximate center of the disc 3 for receiving the fluid leaving the heat transferring medium 2' upstream therefrom and dividing that fluid into a plurality of discrete flow streams which have a net directional flow along the axis 41 of the heat exchanger 1 and, thus, of the general internal flow path 13. Depending on the thickness of the disc 3, the openings 40 may provide for a turbulent-like mixing of the fluid entering the same from the medium 2 and a generally laminar flow directing of discrete streams formed by the respective openings into the downstream medium 2''. The heat exchange disc 4 has a centrally located fluid guiding opening 42, which receives fluid from the medium 2'' collecting the same in a single stream and, depending on the thickness of the disc 4, allows mixing thereof, and further directs the single stream downstream into the heat transferring medium 2 of the next heat exchange unit 25 or in the case illustrated in FIG. 2 into the outlet passage 27 and outlet fitting 14 in the outlet block 7.

The heat exchange discs 3, 4 preferably are arranged in the heat exchanger 1 in an alternating pattern, as is shown in FIG. 1, and preferably, too, there will be a disc 4 at the opposite ends of the heat exchanger adjacent respective blocks 6, 7 so that the central openings 42 thereof can guide fluid with respect to the inlet and outlet passages 26, 27 and so that such end discs 4 complete respective heat exchange units 25 for optimum thermal energy transfer at the respective ends of the heat exchanger. Alternatively, if desired, the respective end heat exchange discs 4 may be eliminated, whereby the heat transferring medium 2 and support ring 5 associated therewith may be placed in abutment with respective blocks 6, 7.

In view of the foregoing, it will be clear that a substantial mixing of the fluid flowing through the internal flow path 13 will occur in the heat exchanger 1. In particular, fluid entering the heat exchanger 1 via the inlet fitting 12 and passage 26 passes through a center opening 42 in a heat exchange disc 4 adjacent the block 6. The fluid then is dispersed well in the first heat transferring medium 2 encountered. Fluid leaving the first heat transferring medium 2 is divided into multiple flow streams by the fluid guiding openings 40 in the next heat exchange disc 3, and the individual streams then enter the next downstream heat transferring medium 2, etc. As a result of the complexity of the internal flow path 13, the fluid flowing therethrough will thoroughly mix and will intimately engage with the large surface area exposure of the plural heat transferring media 2. Moreover, the flowing fluid will tend to come into some contact with the internal heat exchange surfaces 22, 23 of the respective discs 3, 4. The sizes of the openings 40, 42 in the discs 3, 4 may be selected, as desired, according to various parameters and constraints depending, for example, on viscosity of the fluid flowing therethrough, flow rates, pressure drops, mixing required, etc. However, in accordance with the preferred embodiment and best mode of the invention, in order to minimize pressure drop or flow impedance in the heat exchanger 1 while also optimizing mixing and heat transfer occurrence, the cross-sectional area of the fluid guiding opening 42 in each respective heat exchange disc 4, the sum of the cross-sectional areas of the plural fluid guiding openings 40 in each respective heat exchange disc 3, the open cross-sectional area of the respective inlet and outlet fittings 12, 14, and the net open cross-sectional area in the respective heat transferring media, as mentioned above, are the same.

In view of the foregoing, it will be clear that the intimate interengagement of fluid with exposed surface areas of the heat transferring media 2 as the former flows through the latter and is well mixed and thoroughly dispersed therein and guided by respective fluid guiding openings 40, 42 of heat exchange discs 3, 4, an effective transfer of thermal energy will occur between the fluid and the media 2. It is another principal function of the heat exchange discs 3, 4 to supply thermal energy to or to remove thermal energy from the respective heat transferring media 2.

Accordingly, in the preferred embodiment and best mode, the heat exchange discs 3, 4, which are fin-like in the conventional sense that they are exposed at the heating zone 10 to provide relatively large external heat exchange surfaces 43, 44, additionally provide a relatively low impedance heat flow path directly into the heat exchanger and, more particularly, to respective internal heat exchange surfaces 22, 23. Not only does the fluid in the internal flow path 13 directly encounter the internal heat exchange surfaces 22, 23, but also and more importantly such internal heat exchange surfaces provide thermal energy to the heat transferring media 2 with the latter providing an internal heat transfer surface comprised of the total surface area exposure thereof to the fluid in the internal flow path 13. Thus, the heat exchange discs 3, 4 provide the multiple functions of distributing fluid flowing through the internal flow path 13, holding the heat transfer media 2, providing sealing surfaces for the support rings 5, and transferring heat between multiple environments. Preferably each of the heat exchange discs 3, 4 is a single integral unit formed of a material that is a good thermal energy conductor, such as metal, which preferably is unaffected by the fluids to which it is exposed. The discs 3, 4 also preferably should be of relatively thin material for efficient rapid conduction and should be relatively strong to minimize undesired distortion. In the illustrated preferred embodiment of the invention, the discs 3, 4 are circular in plan view to facilitate placement of the entire heat exchanger 1 in a pipe.

In operation of the heat exchanger 1, fluid enters the same via the inlet fitting 12, flows through the same along the internal flow path 13 while mixing thoroughly being dispersed within the heat transferring media 2 and by the heat exchange discs 3, 4 and exits the same via the outlet fitting 14. In the meantime thermal energy is transferred with respect to the flowing fluid; particularly, in the preferred embodiment and best mode heat energy applied to the external heat exchange surfaces 43, 44 is conducted through the respective discs 3, 4 to the internal heat exchange surfaces 22, 23 for transferring with respect to the faces 20, 21 of the heat transferring media 2 for further transfer with respect to the fluid flowing therein. Moreover, on the whole, the mixing of fluid flowing through the internal flow path 13 is with a thoroughness comparable to that achieved in turbulent mixing but without requiring an input of energy needed for turbulent mixing and minimizing the pressure drop between the inlet and outlet fittings 12, 14 so that overall the flow characteristic of the fluid is generally laminar, thus reducing energy input requirements of the heat exchanger 1 while obtaining efficient thermal energy transfer therein.

Due to the turbulence and mixing occurring in fluid flowing through the heat exchanger 1, the prior boundary layer insulation effects and the flow rate discrepancies between inner and outer portions of flow streams are reduced, thus increasing efficiency of thermal energy transfer. Moreover, by conducting thermal energy directly between the heating zone 10 and the internal flow path 13 via the heat exchange discs 3, 4, efficiency of thermal energy transfer is further improved over prior techniques.

An alternate embodiment of heat exchanger **1*a* is illustrated in FIG. 3 in which parts corresponding to those described above with reference to FIGS. 1 and 2 are identified by similar reference numerals with the suffix "a". In the heat exchanger 1*a* there is an internal pipe 50 preferably located along the axis 41*a* of the heat exchanger. The pipe 50 passes through relatively tight fitting openings 51, 52 in the heat transferring media 2*a* and heat exchange discs 3*a* and through loose fitting openings 42*a* in the heat exchange discs 4*a*. The pipe 50 provides for a further isolated flow path inside the heat exchanger 1*a* supplemental to the internal flow path 13*a*, which provides, as above, fluid flow from an inlet fitting through respective heat exchange units 25*a*. The tight fitting openings 51, 52 assure fluid dispersion in the media 2*a* and developing of plural discrete flow streams by the openings 40*a* in the discs 3*a* and the loose fitting openings 42*a* pass the pipe and the fluid therethrough as part of the internal flow path 13*a*** as above.

In the heat exchanger **1*a* the pipe 50** preferably is formed of copper or other metal or material that is unaffected by the fluids engaged therewith and that has a good thermal energy transfer characteristic.

In operation of the heat exchanger **1*a*, for example, a hot fluid may be directed through the pipe 50 from which thermal energy is transferred by conduction through the pipe to the heat transferring media 2*a* and to the heat transfer discs 3*a* for subsequent transfer with respect to the fluid flowing through the internal flow path 13*a*. Moreover, the fluid flow exiting the pipe 50, as represented by arrow 53, may be diverted back over the heat exchanger 1*a* through the external heating zone 10*a* to effect thermal energy transfer directly with respect to the external heat exchange surfaces 43*a*, 44*a***, as described above.

The heat exchanger **1*a* may be referred to as a so-called three pass system in which there are three separate fluid paths, namely that provided through the pipe 50, that provided in the external heating zone 10*a*, and that provided through the internal flow path 13*a*, the latter of which terminates through the outlet passage 27*a* in the end block 7*a* through an outlet fitting (not shown) that also accommodates isolated exiting therethrough of the pipe 50 via the arrow 53. In the preferred form of this alternate embodiment one fluid flows through the pipe 50 and past the external heating zone 10*a* while a second fluid flows through the internal flow path 13*a*; however, it will be appreciated that three isolated fluids may be used, namely one flowing through the pipe 50, one through the heating zone 10*a*, and one through the internal flow path 13*a*** while all such fluids are maintained in fluidic isolation although also being in heat exchange relation with respect to each other.

In the alternate embodiment of heat exchanger **1*b* illustrated in FIG. 4, wherein parts similar to those described above with reference to FIGS. 1 and 2 are identified by the same reference numeral and the suffix "b", the heat exchanger and, thus, the internal flow path represented by the arrow 13*b* therethrough are oriented vertically. The heating zone 10*b* has a tapered profile such that the diameters of the heat exchange discs 3*b*, 4*b* near one end of the heat exchanger 1*b* are of one size and those at the opposite end are of a different size with a gradual change occurring along the axial extent of the heat exchanger. Therefore, in the illustrated embodiment, if hot gases were delivered to the heating zone 10*b* near the bottom of the heat exchanger 1*b*, those gases would tend to rise and to expand while heating the continuously enlarging heat exchange discs 3*b*, 4*b* at the external heat exchange surfaces 43***b*, 44*b* thereof. In the illustrated embodiment of FIG. 4 the larger diameter discs are at the top of the heat exchanger 1*b* to accommodate the expanding hot gases whereby one disc will not totally block flow contact with the next disc; however, for cooling the internal fluid it will be appreciated that if a fluid that tends to drop, such as cold air, were applied to the upper part of the heating zone 10*b*, then the direction of taper thereof would be reversed, namely placing the smaller diameter discs near the top and the larger near the bottom thereof.

Referring now to FIGS. 5 and 6 in which the suffix "c" is used, as above, a further heat exchanger 1*c* in accordance with the invention is illustrated. A tube 60 between the blocks 6*c*, 7*c* isolates the heating zone 10*c* from the external environment of the heat exchanger 1*c*. For clarity of illustration, the tube 60 is not shown in FIG. 6. An inlet 61 supplies a fluid, such as the hot products of combustion, other hot gases, hot liquid, cold gases or liquid, etc. into the tube 60 and an outlet 62 exhausts the same. Moreover, preferably the tube 60 is relatively close fitting with respect to the outer edges of the respective heat exchange discs 3*c*, 4*c* and such discs are bent or distorted and have cut-outs 63, 64 in them to allow flow from an area near one disc to the next disc and so on and to direct a swirling or helical type flow through the heating zone 10*c* from the inlet 61 to the outlet 62.

Referring to FIG. 7, a top plan view schematically illustrates the askew cyclical orientation of the heat exchange discs 3*d*, 4*d* of a heat exchanger 1*d* to create a rotating flow of fluid through the heating zone 10*d*. In particular, the internal flow path 13*d* through the center of the heat exchanger 1*d* actually passes through sector areas of the heat exchange discs 3*d*, 4*d* rather than through the approximate centers thereof, and the discs are positioned in a pattern angularly displaced about the axis of the heat exchanger 1*d* generally to cause a rotating of the fluid flowing through the heating zone 10*d* of the heat exchanger vertically oriented in a manner similar to that illustrated in FIG. 4. Furthermore, if desired, the angularly displaced discs 3*d*, 4*d* also may be slightly deformed in a manner generally depicted in FIGS. 5 and 6 further to create the rotating flow pattern for gases flowing in the heating zone to accomplish a net axial flow thereof.

Figure 8:
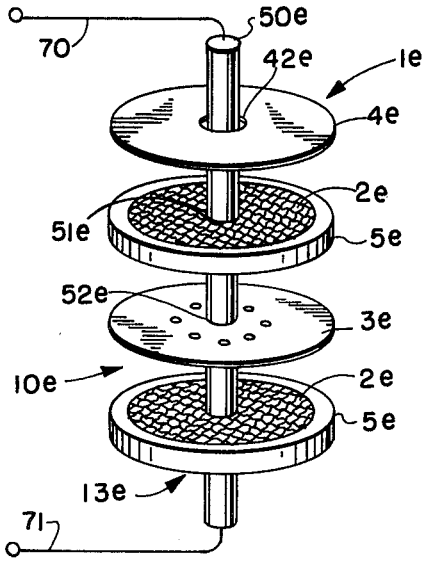
FIG. 8 is a schematic illustration of still a further alternate embodiment of heat exchanger in accordance with the invention.

Turning now to FIG. 8, a heat exchanger 1*e* is schematically illustrated. In the heat exchanger 1*e* the heat exchange discs 3*e*, 4*e* need not extend diametrically beyond the support rings 5*e* of the heat transferring media 2*e*. A pipe or other elongate member 50*e* extends axially along the length of the heat exchanger 1*e*, and the internal flow path 13*e*, relative to the interference caused by the member 50*e* is similar to that described above reference to the internal flow path 13*a* in the heat exchanger 1*a* of FIG. 3. Thus, the member 50*e* passes through a relatively large loose fitting opening 42*e* in the disc 4*e* and similarly in the inlet and outlet blocks (not shown), and the member 50*e* passes in tight fitting relation through the openings 51*e*, 52*e* in the media 2*e* and discs 3*e*, respectively. The significant difference between the heat exchanger 1*e* and that described above with reference to FIG. 3 is that thermal energy input in the form of heat is applied via an electric heating element, such as an electric resistance element located in the member 50*e* or of which the member 50*e* forms a part. Such electric heating may be effected by a conventional electric resistance heating element energized from a conventional power supply via electrical leads 70, 71. Thus, the member 50*e* provides heat directly to the media 2*e* at the close fitting engagements therewith and directly to the discs 3*e* also at the close fitting engagements therewith for distribution by the latter about the respective media 2*e*. The discs 4*e* also further help to distribute uniformly thermal energy in the media 2*e*. Accordingly, it will be appreciated that the heating zone 10*e* of the heat exchanger 1*e* actually is internal of the latter. Moreover, if desired, the diameters of the discs 3*e*, 4*e* may be extended in order to provide external heating surfaces, such as those designated 43, 44 in the preferred embodiment of FIGS. 1 and 2, in order to provide additional thermal energy transfer surface areas with respect to an environment external of the heat exchanger 1*e*.

Figure 9:
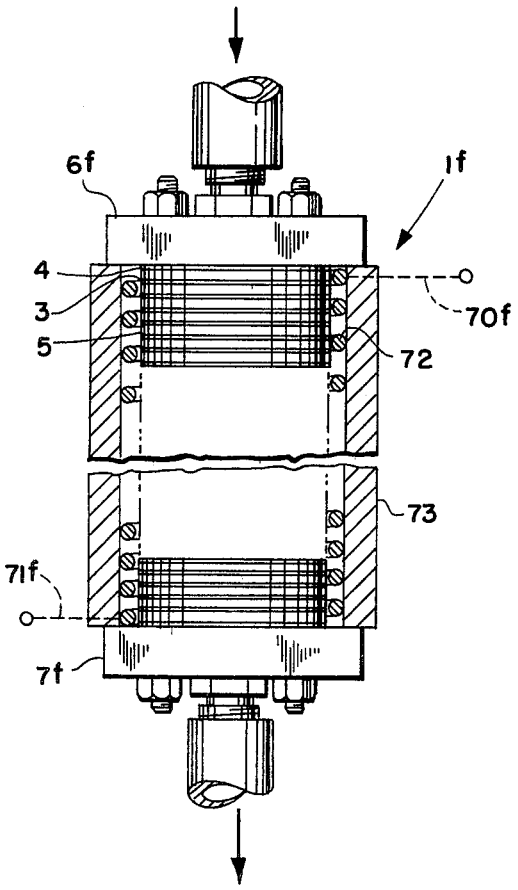
FIG. 9 is a schematic illustration of still an additional alternate embodiment of heat exchanger in accordance with the present invention.

Another example of heat exchanger 1*f* in which thermal energy is supplied electrically is illustrated in FIG. 9. In the heat exchanger 1*f*, which is generally similar to the heat exchanger 1*e*, except that there need not be a member 50*e* internally located along the internal flow path thereof, a conventional electric heating coil 72 is wrapped about the cylindrical wall of the heat exchanger formed by the secured discs 3, 4 and support rings 5 between blocks 6*f*, 7*f*. The heating coil 72 may be energized from a conventional power supply via leads 70*f*, 71*f* to supply heat to the entire outer surface of the heat exchanger, including the outer edges of discs 3, 4 (not shown) and support rings 5 for transfer to the heat exchange media (not shown) internally of the heat exchanger. Moreover, a cover tube or enclosure 73 may be provided to concentrate the heat energy developed by the heating coil 72, to avoid dissipation of such heat energy away from the heat exchanger 1*f*, and, if desired, to provide electrical insulating characteristics for added safety of operation.

STATEMENT OF INDUSTRIAL APPLICATION

In view of the foregoing, it will be clear that the several embodiments of heat exchanger in accordance with the present invention may be employed to transfer thermal energy in an efficient manner. Such transfer may be between two or more fluids to heat or to cool one or more with respect to the other one or more, may be between a fluid and a solid, such as in the case of the electric input embodiments disclosed, etc. Moreover, it will be appreciated that the various features illustrated in the several figures may be interchanged and shared among the several embodiments disclosed; for example, electric heating may be included in the several non-electric heating embodiments, the additional internal isolated flow path of FIG. 3 may be included in the other embodiments, etc.

Several particular applications of the invention include use of the heat exchanger to cool the coolant in an automotive vehicle, to heat water in domestic and commercial environments, to control the temperature of materials in chemical processes, to provide a source of thermal energy for space heating and cooling, and so on.

I claim:

1. A thermal energy transfer apparatus, comprising fluid flow means for conducting the flow of fluid therethrough, including dispersing means for dispersing the fluid flowing through said fluid flow means, and thermal energy transfer means for transferring thermal energy with respect to said dispersing means for transfer between the latter and such fluid flowing therethrough, said dispersing means comprising a mesh-like material having substantial thermal energy conductive properties, said thermal energy transfer means comprising plural plate-like means having first surface area portions engaged with said dispersing means for thermal energy conduction therewith, said fluid flow means including openings in said plate-like means through which fluid may flow, and further comprising holder means for holding said dispersing means and thermal energy transfer means to provide a fluid-tight flow path therethrough, and said fluid flow means further comprising a fluid inlet and a fluid outlet for said fluid-tight flow path.

2. The apparatus of claim 1, each of said dispersing means and at least one plate-like means respectively adjacent thereto comprising a heat exchange unit and the apparatus comprising a plurality of said heat exchange units.

3. The apparatus of claim 1, said dispersing means comprising a metal filter-like material.

4. The apparatus of claim 1, said dispersing means comprising a disc-like dispersing means with opposite faces, and said thermal energy transfer means being positioned to transfer thermal energy with respect to such faces for conduction in said mesh-like material and for transfer via surface areas of such mesh-like material to fluid flowing therein.

5. The apparatus of claim 1, at least one of said plate-like means having a single opening in which fluid may be collected as one stream and through which such collected fluid may pass downstream for dispersal in one of said dispersing means and at least another of said plate-like means having a plurality of openings in which fluid from said at least one dispersing means may be collected in a plurality of streams and through which such collected fluid may pass downstream for dispersion in a subsequent dispersing means.

6. The apparatus of claim 1, said first surface area portion of said plate-like means being in the flow path of fluid through the apparatus, and said plate-like means also having second surface area portions fluidically isolated from such flow path, integral with said first surface area portions and exposed for thermal energy transfer outside such flow path.

7. The apparatus of claim 1, further comprising end blocks respectively at upstream and downstream ends of the apparatus, said dispersing means comprising a plurality of the same, said plate-like means comprising plural plates respectively positioned between dispersing means, and further comprising mounting means for clamping said plates and dispersing means in sandwiched relation between said blocks to provide a fluid flow path for fluid through the apparatus.

8. The apparatus of claim 1, further comprising further flow path means in said fluid flow means fluidically isolated from said fluid-tight flow path and positioned in thermal energy exchange relation with respect to the fluid in said fluid-tight flow path and with at least one of said dispersing means and thermal energy transfer means.

9. The apparatus of claim 8, said thermal energy transfer means comprising plural plates having first surface area portions engaged with said dispersing means for thermal energy conduction therewith, said fluid flow means including openings in said plates through which fluid may flow.

10. The apparatus of claim 8, each of said plate-like means comprising a plate, at least one of said plates having a single opening in which fluid may be collected as one stream and through which such collected fluid may pass downstream for dispersal in one of said dispersing means and at least another of said plates having a plurality of openings in which fluid from said at least one dispersing means may be collected in a plurality of streams and through which such collected fluid may pass downstream for dispersion in a subsequent dispersing means, and said further flow path means comprising a pipe in said fluid-tight flow path passing through said dispersing means in relatively tight fitting relation, passing through said another plates in tight fitting relation and passing through said single opening in said plates in relatively loose fitting relation to permit fluid flow in said fluid-tight flow path via said single openings.

11. The apparatus of claim 10, said first surface area portions of said plates being in said fluid-tight flow path of fluid through the apparatus, and said plates also having second surface area portions fluidically isolated from said fluid-tight flow path, integral with said first surface area portions and exposed for thermal energy transfer outside said fluid-tight flow path, and further comprising means for directing fluid from said further flow path into thermal energy exchange relation with said second surface areas of said plates.

12. The apparatus of claim 2, wherein the apparatus has opposite ends and from one end to the other end thereof said plate-like means being of graduated size.

13. The apparatus of claim 12, said plate-like means being generally flat and of circular plan, such graduated sizes being respectively graduated diametrical dimensions of said plates.

14. The apparatus of claim 1, each of said plate-like means comprising a plate, said first surface area portions of said plates being in said fluid-tight flow path, and said plates also having second surface area portions fluidically isolated from said fluid-tight flow path, integral with said first surface area portions and exposed for thermal energy transfer outside said fluid-tight flow path, the apparatus having an axis, said plates including means for directing flow of fluid in a prescribed path about said second surface area portions and generally along such axis.

15. The apparatus of claim 14, said means for directing comprising bent portions of said plates at said second surface area portions.

16. The apparatus of claim 15, said means for directing further comprising cut-outs in said plates at said second surface area portions for permitting flow of fluid from proximity to one plate to another, the cut-outs of one plate being offset angularly about the axis from the cut-out in the next plate for causing fluid to flow over a substantial area of said second surface area portions of said plates, and further comprising confining means for confining flow of fluid along said second surface area portions of said plates, said means of confining having inlet and outlet means for directing fluid to said plates and for removing fluid therefrom.

17. The apparatus of claim 14, said means for directing flow comprising an axially offset area of said plates, the axially offset area of one plate being offset angularly about such axis differently from that of the next plate and preceding plate, thereby to cause a swirling flow path of fluid flow axially along the apparatus in engagement with said second surface area portions of said plates.

18. The apparatus of claim 1, further comprising an internal heater in said fluid-tight flow path means positioned in thermal energy exchange relation with respect to fluid in said flow path and with at least one of said dispersing means and thermal energy transfer means.

19. The apparatus of claim 18, said heater comprising an electric heater.

20. The apparatus of claim 19, at least one of said plate-like means having a single opening in which fluid may be collected as one stream and through which such collected fluid may pass downstream for dispersal in one of said dispersing means and at least another of said plate-like means having a plurality of openings in which fluid from said at least one dispersing means may be collected in a plurality of streams and through which such collected fluid may pass downstream for dispersion in a subsequent dispersing means, and said heater comprising an electric resistance heater in a pipe, said pipe being positioned in said fluid-tight flow path passing through said dispersing means in relatively tight fitting relation, passing through said another plate-like means in tight fitting relation and passing through said single openings in said plate-like means in relatively loose fitting relation to permit fluid from in said fluid-tight flow path via said single openings.

21. The apparatus of claim 1, further comprising means for delivering thermal energy to said thermal energy transfer means for delivery therethrough and via said dispersing means to fluid flowing through said fluid-tight flow path.

22. The apparatus of claim 21, each of said plate-like means comprising a plate, said means for delivering comprising electric heater means, and further comprising means for concentrating thermal energy developed by said electric heating means on said plates.

23. The apparatus of claim 22, said means for concentrating comprising a container about said electric heating means for minimizing dissipation of thermal energy outside the apparatus.

24. The apparatus of claim 23, said first surface area portions of said plates being in said fluid-tight flow path of fluid through the apparatus, and said plates also having second surface area portions fluidically isolated from said fluid-tight flow path, integral with said first surface area portions and exposed for thermal energy transfer outside such flow path.

25. A thermal energy transfer apparatus for transferring thermal energy between plural media, comprising thermally conductive mesh-like means having relatively large cumulative surface area for transferring thermal energy therethrough, a pair of thermally conductive disc means engaged with said mesh-like means for transferring thermal energy with respect to the latter, holder means for holding said mesh-like means and said disc means in relatively fixed operative spacial relation to provide at least a substantially fluid-tight flow path and with the major surfaces areas of said disc means oriented generally to interrupt the principal direction and at least substantially all of flow of fluid through said flow path of the apparatus, and further comprising a fluid inlet and a fluid outlet to said flow path.

26. The apparatus of claim 25, each of said mesh-like means and at least one disc means respectively adjacent thereto comprising a heat exchange unit and the apparatus comprising a plurality of said heat exchange units.

27. The apparatus of claim 25, said mesh-like means comprising a disc-like dispersing means with opposite faces, and said disc means having a first surface area portion positioned to transfer thermal energy with respect to such faces for conduction in said mesh-like material and for transfer via surface areas of such mesh-like material to fluid flowing therein, and said flow path including openings in said disc means.

28. The apparatus of claim 27, at least one of said disc means comprising a plate having a single opening in which fluid may be collected as one stream and through which such collected fluid may pass downstream for dispersal in one of said dispersing means and at least another of said disc means comprising a plate having a plurality of openings in which fluid from said at least one dispersing means may be collected in a plurality of streams and through which such collected fluid may pass downstream for dispersion in a subsequent dispersing means.

29. The apparatus of claim 27, said first surface area portion of said disc means being in said flow path of fluid through the apparatus, and said disc means also having second surface area portions fluidically isolated from said flow path, integral with said first surface area portions and exposed for thermal energy transfer outside said flow path.

30. A method of transferring thermal energy with respect to a fluid flowing in a heat exchanger, comprising dispersing such fluid as it flows through such heat exchanger using a dispersing medium, and transferring thermal energy with respect to such dispersing medium for transfer between the latter and such fluid being dispersed thereby, said dispersing comprising dispersing fluid through a mesh-like material having thermal energy conductive properties, further comprising transferring thermal energy between the collective surface area of such mesh-like material and the fluid flowing therethrough, and said dispersing further comprising directing a flow of fluid into said mesh-like material for dispersion therein, collecting fluid from said mesh-like material in plural streams, directing such plural streams into a relatively downstream mesh-like material for dispersion therein, collecting fluid from such relatively downstream mesh-like material in a single stream, and directing such single stream into a further relatively downstream mesh-like material, and further comprising providing a fluid-tight path for fluid flowing in the heat exchanger, said dispersing and transferring of thermal energy between such dispersing medium and the fluid comprising effecting the same within such fluid-tight flow path, and said transferring of thermal energy with respect to such dispersing medium comprising directly transferring such thermal energy from a location outside such fluid-tight flow path into such fluid-tight flow path.

31. The method of claim 30, further comprising repeating said dispersing several times.

32. The method of claims 30, said transferring of thermal energy with respect to such dispersing medium comprising conducting thermal energy from a source thereof to such dispersing medium.

33. The apparatus of claim 1, said first surface area portions being aligned generally in perpendicular relation to the principal direction of flow of fluid through said plate-like means and the apparatus.

34. The apparatus of claim 1, said first surface area portions being the major surface area portions of said plate-like means.

35. A method of transferring thermal energy with respect to a fluid flowing in a heat exchanger, comprising generally directing fluid in a principal direction flow through the heat exchanger, dispersing the fluid as it flows through the heat exchanger using a mesh-like thermally conductive dispersing medium, interrupting the principal direction of flow of fluid though the heat exchanger by thermally conductive disc-like means and past which fluid may flow through selected passages, and transferring thermal energy by conduction between the fluid and the dispersing medium and further transferring thermal energy between the major surface area portion of the disc-like means and the dispersing medium, and further comprising providing a fluid-tight flow path for fluid flowing in the heat exchanger, said dispersing and transferring of thermal energy between such dispersing medium and the fluid comprising effecting the same within such fluid-tight flow path, and said transferring of thermal energy with respect to such dispersing medium comprising directly transferring such thermal energy from a location outside such fluid-tight flow path into such fluid-tight flow path.

* * * * *